US005336106A

United States Patent [19]

Osten

[11] Patent Number: 5,336,106

[45] Date of Patent: Aug. 9, 1994

[54] CORD CONNECTORS

[76] Inventor: Frederick F. Osten, 11633 239th St. North, Scandia, Minn. 55073

[21] Appl. No.: 994,980

[22] Filed: Dec. 22, 1992

[51] Int. Cl.[5] ..... H01R 13/62

[52] U.S. Cl. ..... 439/369; 439/371

[58] Field of Search ..... 439/367, 368, 369, 370, 439/371, 373

[56] References Cited

U.S. PATENT DOCUMENTS

| | | | |
|---|---|---|---|
| 1,310,627 | 7/1919 | McEvilly | 285/114 |
| 2,461,427 | 2/1949 | Kneebone | 173/322 |
| 3,475,716 | 10/1969 | Laig | 339/75 |
| 3,781,761 | 12/1973 | Harwood | 439/369 |
| 4,183,603 | 1/1980 | Donarummo | 339/75 |
| 4,221,449 | 9/1980 | Shugart, Jr. | 339/75 |
| 4,440,465 | 4/1984 | Elliott et al. | 339/75 |
| 4,504,106 | 3/1985 | Fechter | 434/369 |
| 4,773,874 | 9/1988 | Kopeski, Jr. | 437/369 |
| 4,898,542 | 2/1990 | Jones, Jr. | 439/369 |
| 4,957,450 | 9/1990 | Pioszak | 439/369 |
| 5,104,335 | 4/1992 | Conley et al. | 439/369 |
| 5,133,671 | 6/1992 | Boghosian | 439/371 |
| 5,211,573 | 5/1993 | Cross | 439/369 |

*Primary Examiner*—Larry I. Schwartz
*Assistant Examiner*—Hien D. Vu
*Attorney, Agent, or Firm*—Jacobson and Johnson

[57] ABSTRACT

A connector for temporarily securing electrical cords in an end-to-end relationship to prevent accidental disconnection comprising an elongated, substantially planar member having a flexible tab integrally formed in a one end of the elongated member, the flexible member and the end of the flexible member defining a pair of cord openings on opposite sides of the tab, with the openings sufficiently large to permit passage of an electrical cord through each of the openings and around the flexible tab with the flexible tab having sufficient support to prevent the flexible tab from disengaging from the cord under normal pressure that does not rupture the cord yet yield to release the cord if pressure is sufficient that it might rupture the cord.

11 Claims, 4 Drawing Sheets

CORD CONNECTORS

FIELD OF THE INVENTION

This invention relates generally to cord connectors, and more particularly, to a one-piece cord connector which can be temporarily secured to a wall.

BACKGROUND OF THE INVENTION

The concept of retainers or cord connectors for preventing the accidental pulling apart of two interconnected electrical cords is well known in the art. Many variations and embodiments of such cord connectors are available. One such embodiment uses a strip with multiple apertures therein. Two cords are woven in and out of the apertures in the connector to frictionally hold the two electrical cords therein.

Still other cord connecting devices use a member which is placed around the outlet ends of the cord and then latched together.

One of the problems with prior art cord connectors is that oftentimes they are not effective or they are clumsy and cumbersome as well as costly and unsuitable for use, particularly when used in construction-type applications.

The present invention provides an improved cord connector which is simple in construction, easy to use and can be temporarily nailed to a surface to hold a receptacle in a ready-to-use condition. In addition, the cord connector of the present invention can be pulled along a surface with minimal chance of the cord connector catching or snagging on an object.

BRIEF SUMMARY OF THE INVENTION

A connector for temporarily securing electrical cords in an end-to-end relationship to prevent accidental disconnection comprising an elongated, substantially planar member having a cord holding region comprising a flexible tab integrally formed in one end of the elongated member, the flexible member and the end of the flexible member defining a pair of cord openings on opposite sides of the tab, with the openings sufficiently large to permit passage of an electrical cord through each of the openings and around the flexible tab. In one embodiment the cord is subject to 360 degree confinement and the flexible tab has a first angled edge for engaging the first end of the cord connector to prevent the flexible tab from pulling through the end of the connector under normal pressure that does not rupture the cord yet yield under pressure that might rupture the cord.

DESCRIPTION OF THE PRIOR ART

U.S. Pat. No. 3,781,761 shows a one-piece cord connector comprised of a strip of flexible material having a plurality of spaced apertures with an entrance width smaller than the apertures communicating therewith. The cords are woven through the apertures to hold the two ends of the cord proximate one another.

U.S. Pat. No. 2,461,427 shows a tension absorber for electrical cords having a hole on one end and a hook on the other end for fastening around the electrical cord to hold the two ends of the electrical cords proximate to one another.

U.S. Pat. No. 5,104,335 shows an electric cord connector which includes a set of straps which has one end secured around the cord and the other end secured to a similar strap to hold the two ends of the electrical cords proximate one another.

U.S. Pat. No. 5,133,671 shows a pair of straps which connect to the ends of the electrical cord with the straps having ratchet teeth which engage a slot in the opposite member to hold the ends of the two electrical cords proximate one another.

U.S. Pat. No. 4,773,874 shows a cord clip comprising a resilient, one-piece strip having a U-shape for fitting around the ends of two electrical cords to hold the ends of the electrical cords proximate one another. A string connects the cord clip to the cord to prevent loss of the cord clip.

U.S. Pat. No. 3,475,716 shows a retainer for an electrical cord having an apertured member for fitting around one end of a cord and a strap located on the opposite end for fastening around a second cord to secure the ends of electrical cords proximate one another.

U.S. Pat. No. 4,183,603 shows an external cord lock similar to U.S. Pat. No. 3,475,716 with the cord lock having an aperture on one end and a split-apertured housing on the opposite end for securing the ends of electrical cords proximate one another.

U.S. Pat. No. 4,221,449 shows a locking device for holding electrical cords comprising a pair of winged locking members which allows lateral insertion of the cord therebetween including means for adjusting the position of the locking members in relationship to the ends of the electrical cords.

U.S. Pat. No. 4,440,465 shows an electrical plug connector having a collar for placing around the cord and a pair of straps for forming interlocking connection with a similar connector to hold the ends of the two electrical cords proximate one other.

U.S. Pat. No. 1,310,627 shows a locking device which has a forked end and a locking collar for holding a gas supply pipe proximate a gas valve.

U.S. Pat. No. 4,957,450 shows a plug and socket retainer using a strap having apertures therein for fitting around the ends of the cords and a Velcro-like material on the ends of the strap for holding the ends of the electrical cords proximate one another.

DESCRIPTION OF THE PREFERRED EMBODIMENT

Figure 1:
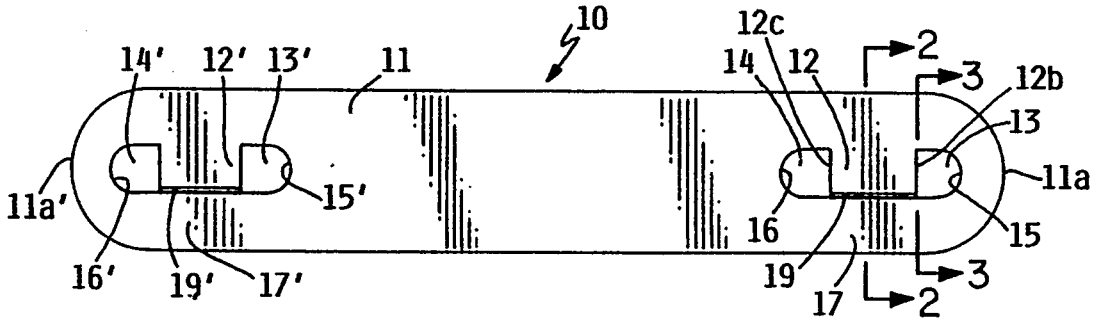
FIG. 1 shows a top view of the present invention.

FIG. 1 reference numeral 10 generally identifies the one-piece cord connector of the present invention. Located at one end of cord connector 10 are means for holding one electrical cord and located on the opposite end of cord connector 10 are identical means for holding another electrical cord therein. Since both cord connecting means are the same, only one will be described herein.

A cord connector means comprises a flexible thumb-tab 12 which is located proximate base member 17. Defined on each side of flexible thumb-tab 12 are a pair of openings, a first opening 13 and a second opening 14. A portion of opening 13 has a semi-cylindrical shape or arcuate surface 15, and similarly, a portion of opening 14 has a semi-cylindrical shape 16 which generally conform to the shape of the electrical cords.

The outside end of connector 10 has a circular or arcuate surface 11*a* which is for the purpose of preventing the connector from catching on an object if the cords are pulled along the ground. That is, the rounded end functions to direct the connector around any object in its path.

Figure 3:
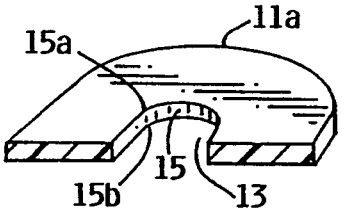
FIG. 3 shows cross-sectional perspective view, taken along lines 3—3 of FIG. 1.
Figure 4:
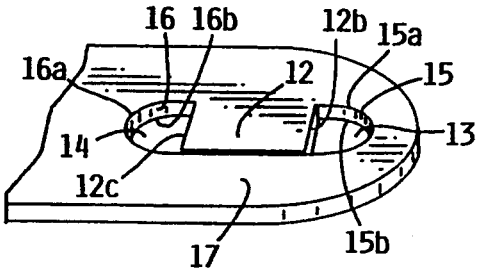
FIG. 4 shows a perspective view of the end of the cord connector of FIG. 1.

FIGS. 3 and 4 better illustrates working regions of the cord connector which comprise an arcuate surface 15, an upper arcuate internal edge 15*a* and a lower internal, arcuate edge 15*b* which engages and bites into the cord as the cord extends around flexible tab 12. Tab 12 includes a first side surface 12*b* that together with arcuate surface 15 defines a first cord opening 13. Similarly, tab 12 includes a second side surface 12*c* that together with arcuate surface 16 defines a second cord opening 14.

Figure 2A:
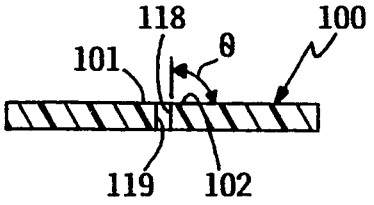
FIG. 2A shows a cross-sectional view, taken along lines 2A—2A of FIG. 1A.
Figure 2:
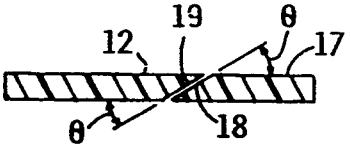
FIG. 2 shows a cross-sectional view, taken along lines 2—2 of FIG. 1.

Flexible tab 12 is shown in cross section in FIG. 2. The free end of tab 12 includes an angled end 19 which engages a corresponding angle end 18 or support surface carried by one end of planar member 10 on base member 17. Similarly, a second support surface is carried by the opposite end of planer member 10. Cord connector 10 is made from a single-piece, flexible material such as high density polyethylene and typically has a thickness of approximately 90 mil. This material, while flexible, is characterized by having a small amount of memory although also providing resiliency.

Figure 5:
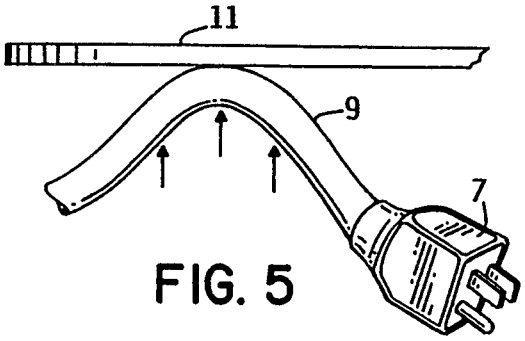
FIG. 5 illustrates a step in insertion of a cord into the cord connector of FIG. 1.
Figure 6:
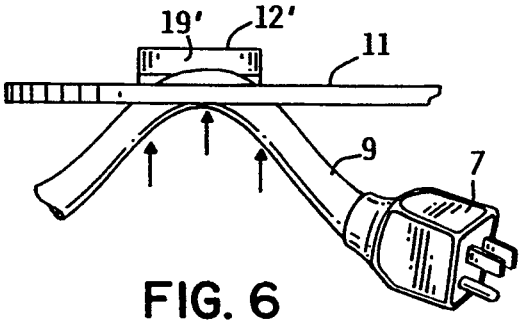
FIG. 6 shows the flexing of the tab as the cord is inserted into the cord connector of FIG. 1.
Figure 7:
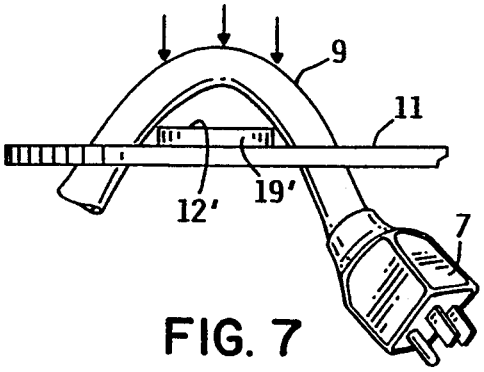
FIG. 7 shows the cord being secured to the cord connector of FIG. 1.

To illustrate the attachment of a cord to one end of the cord connector, reference should be made to FIGS. 5, 6 and 7. FIG. 5 illustrates cord 9 bent in a U-shape as it is about to be inserted into one end of the cord connector. The arrows show the direction of motion. FIG. 6 illustrates that the flexible thumb-tab 12' flexes upward as one pushes cord 9 through the cord connector. FIG. 7 illustrates cord 9 extended sufficiently far through connector 10 so that a U-shaped loop in cord 9 clears flexible tab 12'. Once pushed through, the arrows indicate that cord 9 is forced downward to engage the top portion of flexible tab 12' and thus push flexible tab 12' into locking engagement with base member 17 and thus prevent flexible tab 12' from being pulled through cord connector 10.

Similarly, a second cord is extended through the opposite end of cord connector 10.

Figure 8:
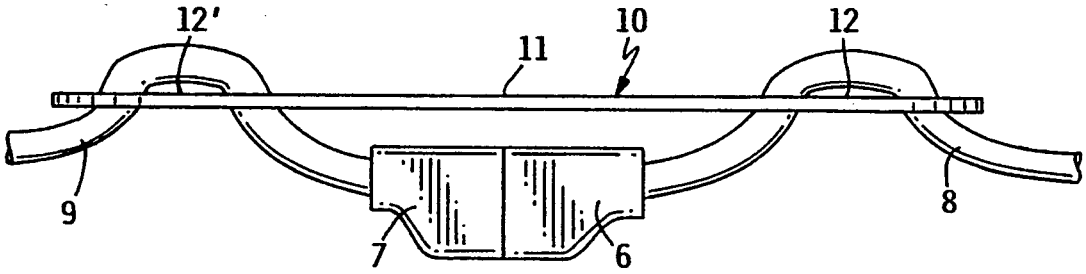
FIG. 8 shows a side view of the ends of two cords secured to the cord connector of FIG. 1.

FIG. 8 illustrates two cords 8 and 9 extending through cord connector 10 with electrical receptacle 6 of cord 8 engaging plug 7 of cord 9 while both cords are securely held by friction between the cords and the cord connector components.

It can be seen from the embodiment in FIGS. 1 through 8 that the cord 8 is securely and frictionally held by the coaction of flexible tab 12 with lower edge 15*b* and lower edge 16*b* and cannot be removed unless flexible tab 12 is pushed upward to release cord 8. Similarly cord 9 is securely and frictionally held by the coaction of flexible tab 12' with lower edge of surface 15' and lower edge of surface 16' and cannot be removed unless flexible tab 12' is pushed upward to release cord 9. The flexible tabs prevent accidental removal of the cords from the cord connector since it requires a positive action to remove the electrical from the cord connector. In addition, my cord connector is of simple construction, made of one-piece material and is subject to on-site abuse without damaging of the connector.

In the embodiment shown, the angle of surfaces 18 and 19 is approximately 45 degrees to a plane extending longitudinally along the top of bottom of connector 10. The angle of approximately 45 degrees provides sufficient locking support between tab 12 and member 17, yet permits tab end 19 to slidingly pass over end 18 if sufficient pressure is applied to the cord which may break the cord. That is, tab 12 will be flexed on the opposite side of connector allowing the cord to be pulled free of connector 10. In addition, the arcuate edges on the inside of the cord connector extend around the cord to distribute forces around the cord thereby avoiding puncturing or tearing of the cord and causing cord failure.

Figure 9:
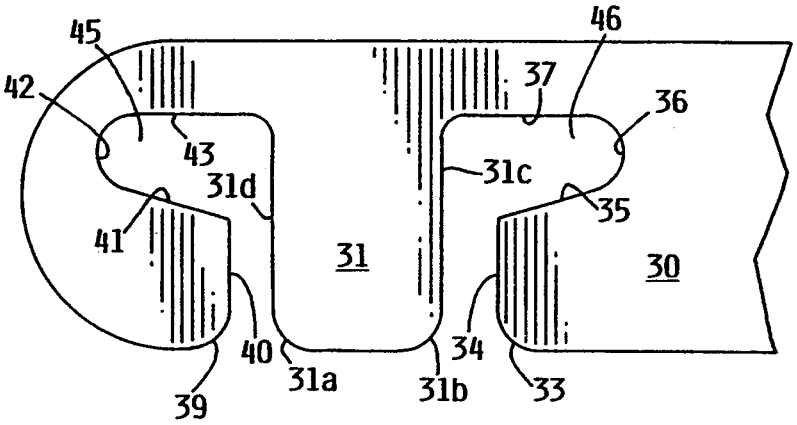
FIG. 9 shows a partial top view of an alternate embodiment with an external tab-locking arrangement for holding electrical cords therein.
Figure 10:
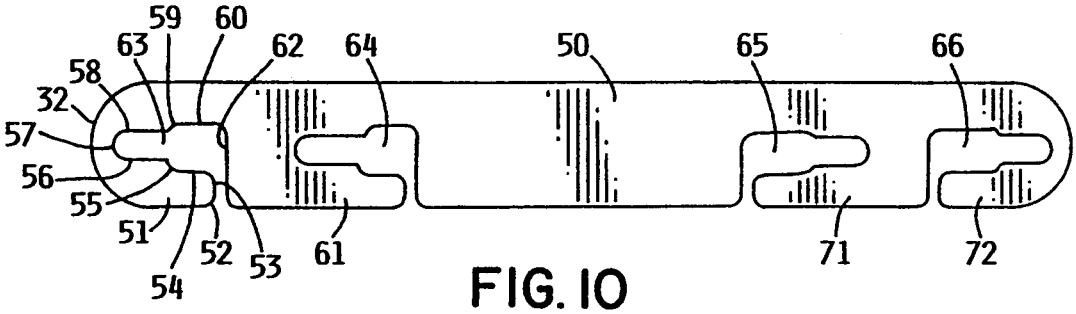
FIG. 10 shows a further alternate embodiment of a cord connector for holding electrical cords therein.
Figure 11:
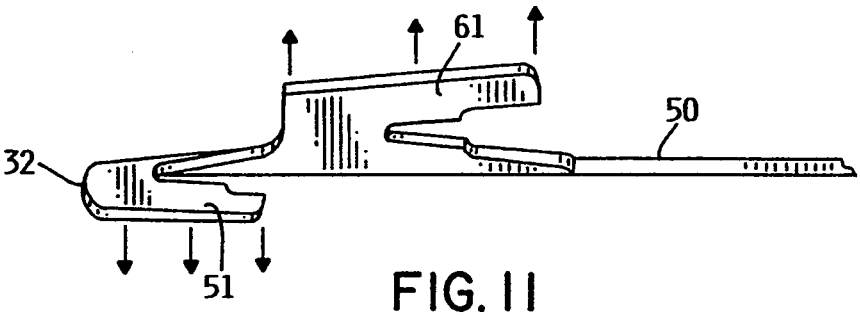
FIG. 11 illustrates the flexing of the cord connector of FIG. 10 prior to connecting to an electrical cord.

One of the features of the invention is that the cord connector will yield and not rupture the cord. I have found a point of yield can more accurately and reliably be determined when the cord is confined by surfaces extending 360 degrees around the cord In addition while the angle of surfaces 18 and 19 is shown as 45 degrees the angle of the ends can be varied from 0 degrees to 90 degrees depending on the desired resistance to cord pull through. For example, with shallower angles the overlap of angled end 18 and angled end 19 is greater thereby providing greater resistance to cord pull through. On the other hand, with a steeper angle, the resistance to cord pull through is decreased. For example, when the angle of the end is 90 degrees, end 19 and end 18 do not provide any support for one another. In such an embodiment, the sole support for the cord is only provided by cantilever resistance of tab 12. However, the 360 degree confinement of a cord in cord opening 13 and in cord opening 14, such as shown in FIG. 1, provides more accurate predetermination of resistance to cord pull-through than in the embodiment, such as shown in FIGS. 9–11, wherein there is not 360 degree confinement. That is, if the cord is not confined in a 360 degree mode, the cord slips out toward the end of the flexible tab as where less pressure is required to flex the tab and consequently, pull the cord through the cord connector. Thus, the use of 360 surfaces surrounding cord allows one to more precisely determine the forces that would pull the cord through the connector, since pulling forces on the cord act on specified position of the flexible tab.

Figure 1A:
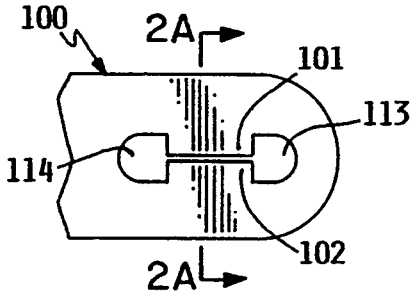
FIG. 1A shows a top view of an alternate embodiment of the invention of FIG. 1.

In addition, while a single tab 12 is shown extending from one side of connector, two flexible tabs could also be used which extend from opposite sides of connector toward the middle of connector. FIGS. 1A and 2A show a connecter 100 with a first flexible tab 101 and a second flexible tab 102 which have angle ends of 90 degrees. Note the cord connecter openings 113 and 114 provide 360 degree containment of the cord while the end 118 of tab 101 and end 119 of tab 119 do not provide support for one another.

FIG. 9 shows an alternate embodiment of a flexible tab including an external, flexible open-end thumb tab 31 which is suitable for use with various diameter electrical cords. The connector shown in FIG. 9 includes a flexible thumb-tab 31 having a pair of curved edges 31*a* and 31*b* for guiding electrical cord therein. Located on one side of tab 31 is a straight cord-guiding surface 31*c* and similarly on the opposite side of tab 31, a straight cord-guiding surface 31*d*.

Located one one side of tab 31 is a converging opening 45 for receiving a portion of an electrical cord and similarly located on the opposite side is an identical shaped converging cord opening 46 for receiving a further portion of an electrical cord. Cord converging opening 45 is partially defined by a cord-engaging surface 43 which is connected to angled cord-engaging surface 41 by a semi-circular or arcuate cord-engaging surface 42. When in use cord-guiding surfaces 40 and 31*d* direct a cord into converging opening 45 and into engagement with the semi-circular or arcuate cord-engaging surface 42.

Similarly, located on the opposite side of tab 31 is converging opening 46 for receiving a further portion of an electrical cord with cord converging opening 46 partially defined by a cord-engaging surface 37 which is connected to angled cord-engaging surface 35 by a semi-circular or arcuate cord-engaging surface 36. When in use cord-guiding surfaces 34 and 31*c* direct a cord into converging opening 46 and into engagement with the semi-circular or arcuate cord-engaging surface 36.

It will be noted that the converging cord openings 45 and 46 around tab 31 have curved cord-engaging surfaces 42 and 36 for engaging a portion of the cord, but they also have first converging cord-engaging surfaces 35 and 37 and second converging cord-engaging surfaces 41 and 43 to allow connector 30 to be used with various sized cords. That is, when pulled the cords extend sufficiently far into the converging cord openings 45 and 46 until they snugly fit into the converging cord openings.

FIG. 10 reference numeral 50 identifies an alternate embodiment of the invention having a plurality of flexible tabs and a series of L-shaped openings 63, 64, 65 and 66 for extending a cord through. Since each of the openings is identical, only one will be described herein. The cord connector of FIG. 10 has a first flexible tab 51, a second flexible tab 61 a third flexible tab 71 and a fourth flexible tab 72. Flexible tab 51 has a curved end 32 for guiding a connector over objects. The connector 50 includes pairs of coacting surfaces which guide the cord into position for securing a cord in the connector 50. Surfaces 52, 53 and 62 coact to guide a cord into opening 63. Surfaces 54 and 60 coact to guide a cord to the closed end of opening 63. Surfaces 55 and 59 guide the cord into a narrower opening defined by cord-engaging surfaces 56 and 58. The end cord-engaging surface 57 connecting surfaces 56 and 57 is rounded or arcuate to fit around the outer surface of a cylindrical cord. The use of flexible material in connector 50 prevents the connector from rupturing or cutting the cord if one applies to much pressure on the cord.

To illustrate the attachment of cord connector of FIG. 10 to a cord, reference should be made to FIG. 11 which shows tab 51 bent downward and tab 61 bent upward to allow insertion of a cord therein. In both the embodiments of FIGS. 9 and 11, the cord connector can be flexed sufficiently so that the cord requires less flexing. This makes the cord connector well suited for stiffer or heavier electrical cords.

Figure 12:
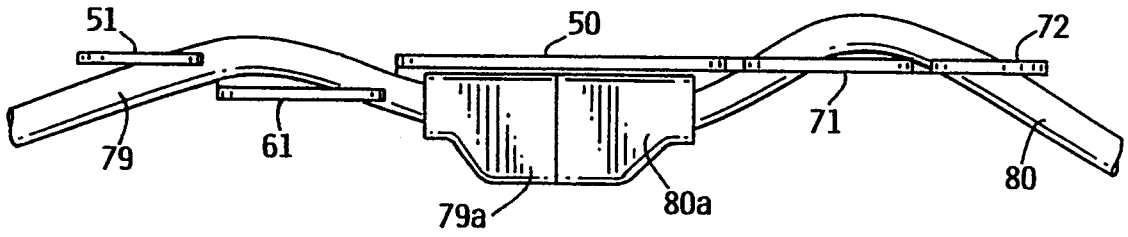
FIG. 12 shows a cord connector of FIG. 10 partially connected to the ends of a pair of electrical cords.

FIG. 12 shows cord connector 50 partially attached to a cord 79 and fully attached to a cord 80. Note tab member 61 is not completely in alignment with connector 50. However, since cord connector tab 61 has sufficient resiliency, the operator can work the tab around cord 79 by pushing upward on tab 61 to form secure connections around cord 79. Tab 71 is shown in alignment with connector 50 so that cord 80 is trapped in connector 50, thereby holding cord end 80*a* proximate cord end 79*a*.

One of the features of the present invention is that the cord connector is made from nailable material. That is, a nail can be driven through the connector without destroying the connector. One of the problems of working on second stories and above is that the electrical cords needed for power tools are quite cumbersome when elevated and frequently separate under theft own weight. The present invention permits a user to quickly secure one end of a cord at a second level and above by nailing the connector to a stud or the like to provide a temporary, stationary power source for such tools.

Figure 13:
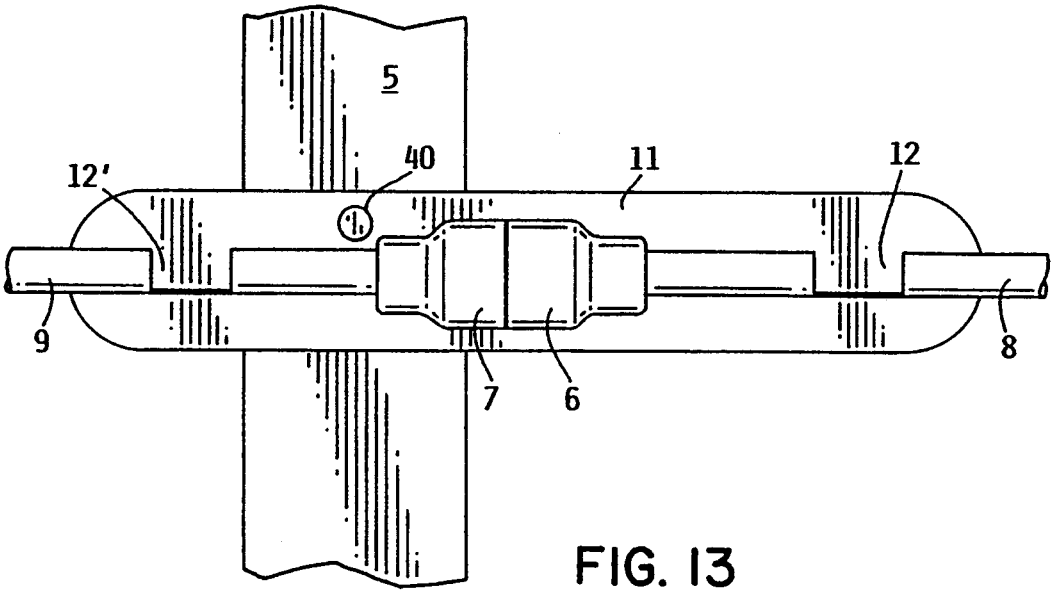
FIG. 13 shows cord connector of FIG. 1 nailed to a stud.

FIG. 13 shows a nail 40 extending through connector into a stud 5 to hold cords 8 and 9 in position. That is, cord 9 and its outlet 7 are firmly held in position so that a cord 8 and its outlet 6 can be attached thereto and held in position without fear of the cords separating.

Figure 14:
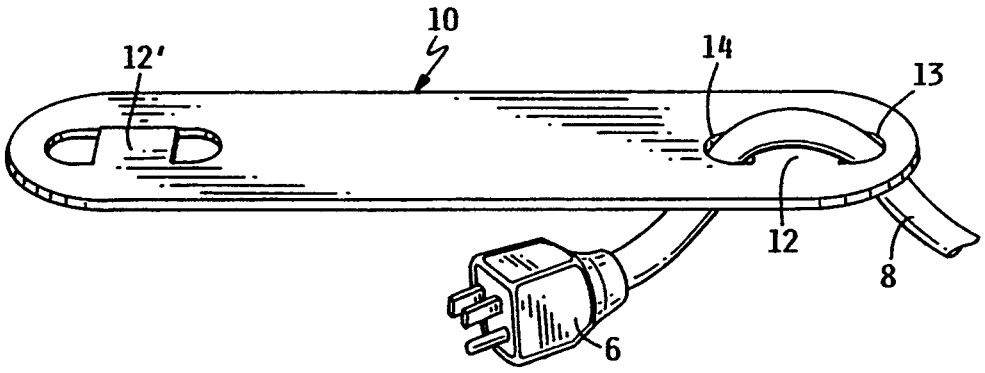
FIG. 14 shows the cord connector of FIG. 1 connected to one end of an electrical cord.

FIG. 14 illustrates another feature of the present invention, namely, in that cord connector 10 is semi-permanently attached to the cord 8. That is, because flexible tab 12 is self-locking, it secures cord 8 to cord connector 10 during normal use so that it will be readily available if the party wishes to connect cord 8 to another cord.

Another feature of the cord connector invention is that the flat central region between the flexible tabs is suitable for printing advertising information on one side and/or instructions for use of the cord connector on the other side.

I claim:

1. A connector for temporarily securing electrical cords in an end-to-end relationship to prevent accidental disconnection comprising:

an elongated, substantially planar member formed from a flexible material, said member having a first end and a second end; and a first support surface carried by said first end of said planar member;

a first flexible tab integrally formed in said first end of said elongated member, said first flexible tab having an end surface for engaging said first support surface wherein said end surface is located on an opposite side from said first support surface, a first side surface and a second side surface, said first end of said planar member having a first edge and a second edge, said first edge and said first side surface defining a first cord opening, said second edge and said second side surface defining a second cord opening with said openings located on opposite sides of said first flexible tab, said openings sufficiently large to permit passage of a first cord through each of said openings and around said flexible tab, said edges forming cord engaging surfaces for biting and engaging said first flexible tab having sufficient cantilevered resistance to prevent said tab from being pulled free of said first support surface under normal pulling pressure that would not rupture the first cord held therein yet permit pulling the flexible tab free of said first support surface under pulling pressure that would rupture the first cord held therein.

2. The connector of claim 1 including a second support surface carried by said second end of said planar member;

a second flexible tab integrally formed in said second end of said elongated member, said second flexible tab having an end surface, a first side surface and a second side surface, said second end of said planar member having a first edge and a second edge, said first edge and said first side surface defining a third cord opening, said second edge and said second side surface defining a fourth cord opening with said third and fourth openings located on opposite sides of said second flexible tab, said third and fourth openings sufficiently large to permit passage of a cord through each of said third and fourth openings and around said second flexible tab, said edges on said second flexible tab forming cord engaging surfaces for biting and engaging a second cord located therein to prevent sliding of the second cord therepast said second flexible tab having sufficient cantilevered resistance to prevent said second tab from being pulled free of said second support surface under normal pulling pressure that would not rupture the second cord held therein yet sufficiently weak cantilever resistance to permit pulling the second flexible tab free of said second support surface under pressure that would rupture the second cord held therein.

3. The connector of claim 2 including an angled end surface on said first flexible tab and an angled end surface on said second flexible tab.

4. The connector of claim 3 wherein the angled end surface of said said first flexible tab and said angled end surface of said second flexible tab is about 45 degrees.

5. The connector of claim 3 wherein said first edge and second edge on said first end has an arcuate shape.

6. The connector of claim 1 wherein said material is polyethylene having a thickness of about 90 mil.

7. The connector of claim 3 wherein the first support surface on the first end of the planar member and the second support surface on the second end of the planar member each includes an angled end of about 45 degrees for respectively mating with said angled end of said first flexible tab and said angled end of said second flexible tab.

8. The connector of claim 1 wherein the first opening and the second opening include surfaces that provide 360 degree confinement of a cord located therein

9. A connector for temporarily securing electrical cords in an end-to-end relationship to prevent accidental disconnection comprising:

a member formed from a flexible material, said member having a first end and a second end, said first end of said member carrying a tab support surface; and a flexible tab integrally formed in said first end of said elongated member, said flexible tab having a first side surface and a second side surface, said first end of said flexible member and said first side surface and said second side surface defining a pair of openings on opposite sides of said first flexible tab, said openings sufficiently large to permit passage of a cord through each of said openings and around said flexible tab, said edges forming cord engaging surfaces for biting and engaging a cord located therein, said first flexible tab having sufficient resiliency to prevent a cord from being pulled free of said tab support surface under normal pulling pressure that would not rupture a cord held therein yet permit pulling said flexible tab free of said tab support surface under pulling pressure that would rupture the cord held therein.

10. The connector of claim 9 wherein said flexible material is puncturable to permit securing said connector to a surface by driving a fastener therethrough.

11. The connector of claim 9 including a region between the flexible tabs suitable for printing advertising information or instructions for use of the cord connector.

* * * * *